United States Patent [19]

Rockwell

[11] 3,994,349

[45] Nov. 30, 1976

[54] APPARATUS FOR RECLAIMING STRIP-MINED LAND

[75] Inventor: Harvey W. Rockwell, Springfield, Ill.

[73] Assignee: Fiat-Allis Construction Machinery, Inc., Deerfield, Ill.

[22] Filed: Jan. 27, 1975

[21] Appl. No.: 544,334

[52] U.S. Cl. ..... 172/292; 172/804; 172/387; 172/315; 172/277; 172/1; 37/195

[51] Int. Cl.[2] ..... A01B 51/00; E02F 3/76

[58] Field of Search ..... 172/292, 801, 1, 387, 172/804, 315, 277; 37/195

[56] References Cited

UNITED STATES PATENTS

| | | | |
|---|---|---|---|
| 3,552,497 | 1/1971 | Stedman | 172/292 |
| 3,661,214 | 5/1972 | Peterson et al. | 172/801 |
| 3,823,782 | 7/1974 | Howland | 172/292 |
| 3,884,310 | 5/1975 | Soucek et al. | 172/292 |

*Primary Examiner*—George J. Marlo
*Attorney, Agent, or Firm*—Thomas F. Kirby; Robert A. Brown

[57] ABSTRACT

Apparatus and method are provided for reclaiming strip mined land. The apparatus generally comprises a leading tractor and a trailing tractor and an elongated adjustable side casting blade angularly disposed between and connected to the tractors. Control of both tractors and blade adjustment is carried out by an operator on the leading tractor. The method generally comprises the steps of driving the apparatus along a spoil bank crest near one side thereof in one direction to make one pass to effect side casting of material down one repose slope of the spoil bank and then driving the apparatus along the spoil bank crest near the other side thereof in the opposite direction to make another pass to effect side casting of material down the other repose slope of the spoil bank. Two such passes constitute one complete cycle and blade angle; blade tilt and depth of cut are changed for each pass.

14 Claims, 4 Drawing Figures

APPARATUS FOR RECLAIMING STRIP-MINED LAND

BACKGROUND OF THE INVENTION

1. Field of Use

This invention relates generally to apparatus and a method for reclaiming strip mined land. In particular it relates to apparatus comprising a leading tractor and a trailing tractor and an elongated angularly disposed side casting dozer blade adjustably mounted therebetween and to a method for operating such apparatus on an elongated spoil bank to shift materials therefrom into adjacent depressions.

2. Description of the Prior Art

Strip mining operations to obtain coal or other minerals are often carried out on land which originally has a generally level substantially horizontal grade. After the strip mining operation is carried out the land is left in the condition of having generally parallel spoil banks having crests spaced apart, for example, about 120 feet and extending, for example, 15 to 20 feet above the original grade, with a depression, trough or valley between each adjacent pair of spoil banks and extending, for example, 15 to 20 feet below the original grade. A side of a spoil bank and the side of the valley therebelow merge into a common slope called the "repose slope". The "repose angle" is the angle the repose slope makes with the horizontal and is determined by the particles of material settling into a state of repose under the force of gravity. Typically, the repose angle may be in the range of 26° to 38° from the horizontal, depending on the nature of the material forming the spoil bank and the age of the spoil bank. Heretofore it was the practice to employ conventional bulldozers or specialized forms of earth moving machinery to restore the land to its original condition by pushing or conveying the materials forming the spoil bank into the adjacent valleys. However, since a considerable volume of material needs to be moved, the use of conventional existing machinery and techniques can be very time consuming, costly and hard on equipment. It is known that land reclamation can be carried out more efficiently by, for example, a bulldozer having a blade of substantially greater width than is conventionally employed in most earth moving operations. However, the power available in a single tractor and the problem of balance limits the size of blade that can be used. It is also known to employ two or more tractors to push a single blade of relatively greater width, and U.S. Pat. No. 3,661,214 shows an arrangement wherein three tractors are disposed in side by side relationship and coupled together by a bracing structure to maintain a forced parallelism and a predetermined longitudinal relationship while they operate to push a common bulldozer blade. U.S. Pat. No. 3,552,497 teaches a generally similar arrangement. Tests have also been carried out starting in July, 1972 wherein test apparatus comprising two separate tractors of about 385 horsepower each, each having its own driver, were employed to move a common blade which was on the order of about 40 feet long and disposed at an angle of about 50° with respect to the path of travel, one tractor pushing the blade and the other tractor acting to pull the blade by means of a flexible wire cable about 2 inches in diameter connected between the leading tractor and the leading end of the blade. The principal function of the leading tractor was to help counteract the side thrust forces imposed upon the blade. In the aforementioned tests the tractors exerted a combined force of about 770 horsepower on the blade. In the aforementioned test apparatus all controls for effecting changes in the position of the blade were provided between the blade and the trailing tractor and were controlled by the operator on the trailing tractor.

SUMMARY OF THE PRESENT INVENTION

Apparatus and method are provided for reclaiming strip mined land. The apparatus generally comprises a leading tractor and a trailing tractor and an elongated adjustable side casting blade angularly disposed between and connected to the tractors. Control of both tractors and blade adjustment is carried out by remote control by an operator on the leading tractor. Means are provided for connecting the rear end of the leading tractor to the leading end of the blade and such means allow blade pivoting in all directions, as well as vertical adjustment of the leading end of the blade. Means are provided for connecting the trailing tractor to the blade at some distance from the trailing end of the blade and such means serve to stabilize the connection between the trailing tractor and the blade and enable the blade angle, pitch, tilt, and vertical position to be adjusted.

The method generally comprises the steps of driving the apparatus along a spoil bank crest near one side thereof in one direction to make one pass to effect side casting of material down one repose slope of the spoil bank into the adjacent valley and then driving the apparatus along the spoil bank crest near the other side thereof in the opposite direction to make another pass to effect side casting of material down the other repose slope of the spoil bank into the other adjacent valley. Two such passes constitute one complete cycle. The blade angle is increased to cut a wider swath, the depth of cut is decreased, and the blade tilt is decreased for each successive cut.

The apparatus and method in accordance with the present invention offer several advantages over the prior art. For example, both tractors use standard hydraulic cylinders and controls for performing their respective control functions. The remote control means and the means for interconnecting the blade and the tractors are easily disconnectable to allow each tractor to be employed separately in a conventional manner. The means for interconnecting the tractors and the blade insures stable mounting of the blade while enabling freedom of relative movement between the two tractors and the blade. The blade is greatly positionable to provide a cut or pass of the required width and depth. The method of employing the apparatus allows continuous forward travel of the apparatus and continuous side casting of a large volume of material from the spoil bank thereby resulting in more efficient and economical reclamation of land.

Other objects and advantages of the invention will hereinafter appear.

DRAWINGS

Figure 4:
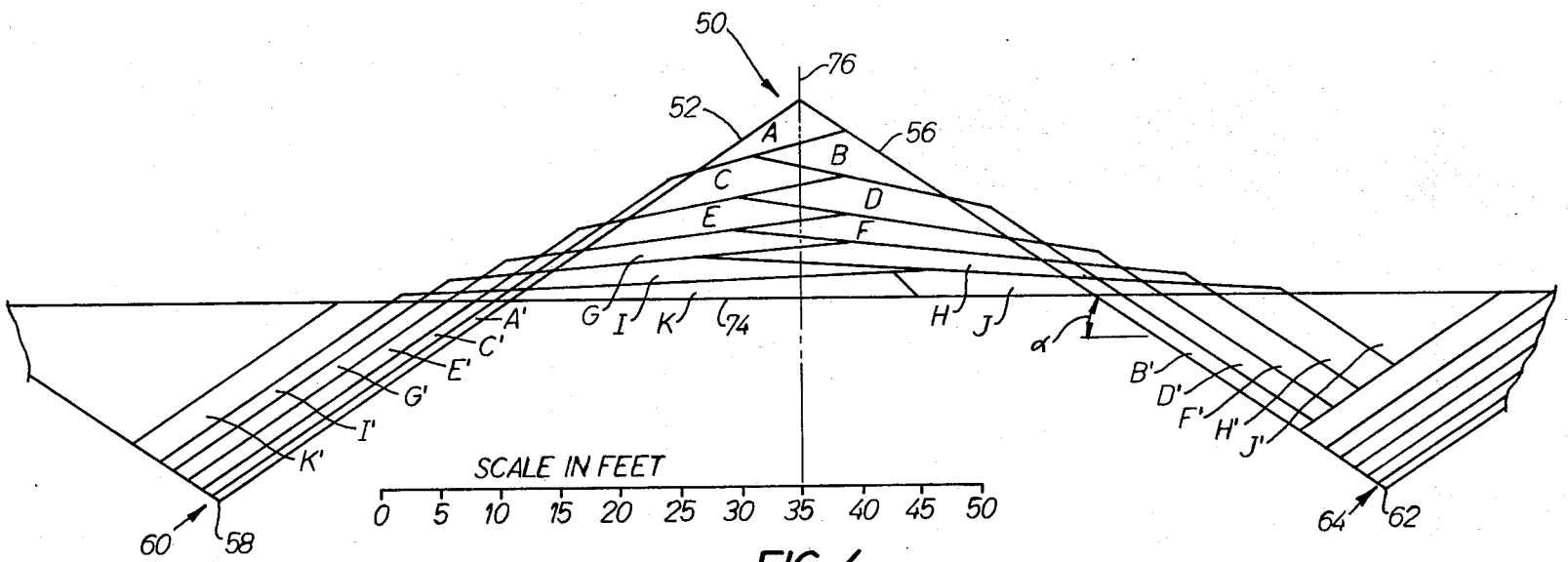
Figure 3:
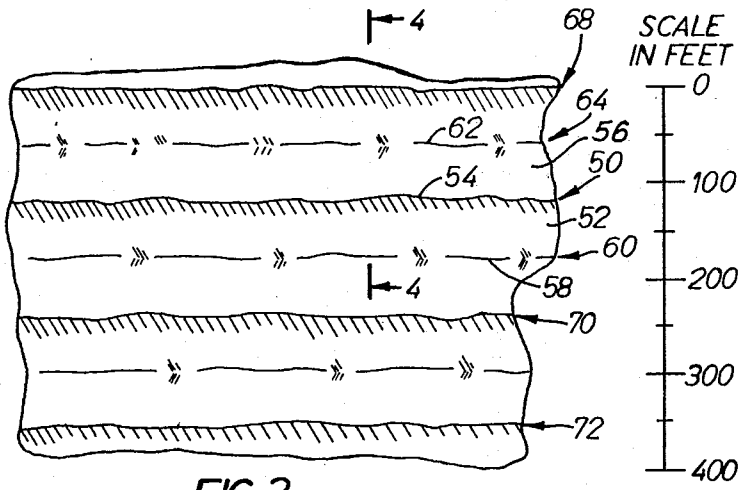

FIG. 3 is a schematic top plan view of a portion of a geographic area which has been strip mined and showing the relative position of spoil banks and valleys thereat; and FIG. 4 is an enlarged schematic view taken on line 4—4 of FIG. 3 and showing a cross-sectional view of one spoil bank and its two adjacent valleys and further showing a method in accordance with the invention of making cuts along the spoil bank by means of apparatus in accordance with the present invention.

DESCRIPTION OF A PREFERRED EMBODIMENT

Figure 1:
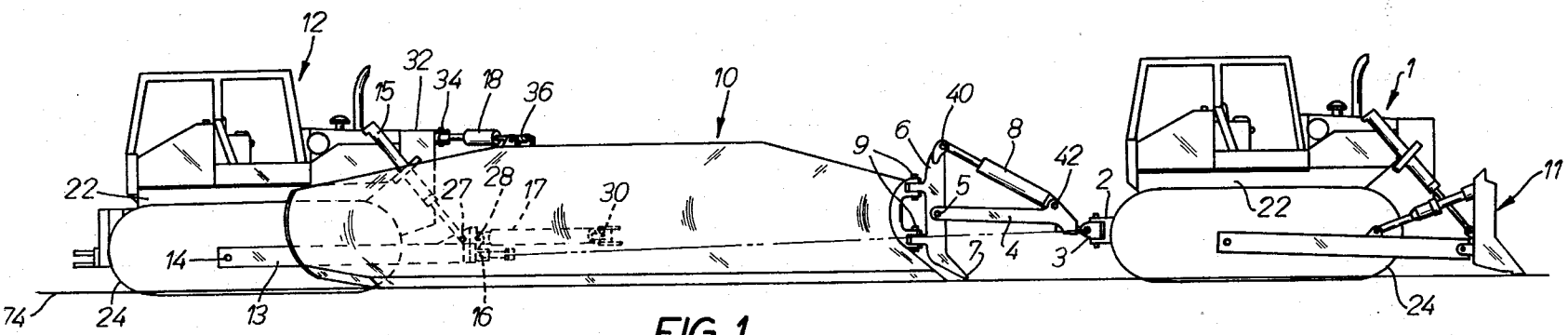
FIG. 1 is a side elevational view of apparatus in accordance with the present invention, including a leading tractor, a trailing tractor, and a side casting blade connected to and between both tractors.
Figure 2:
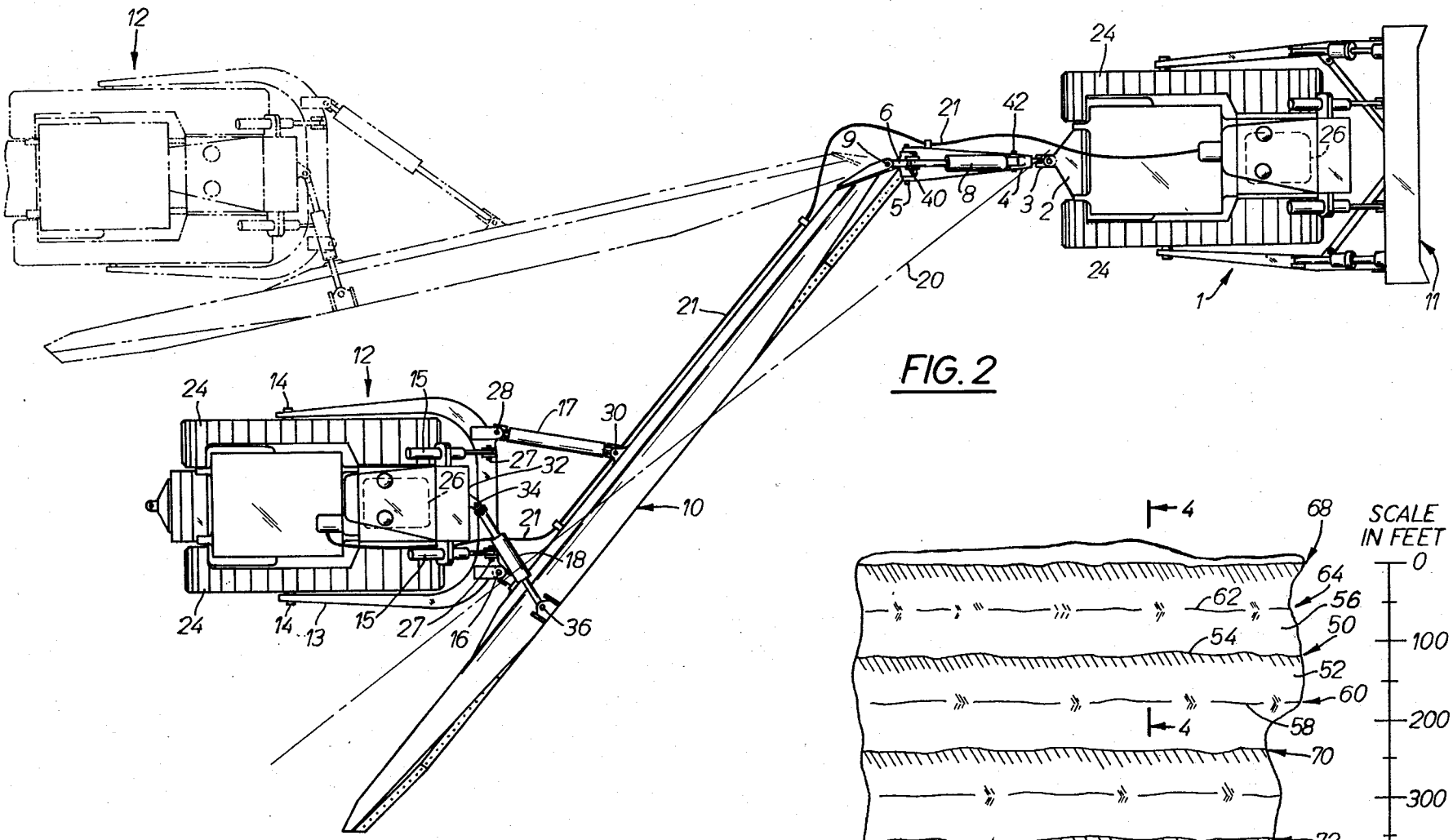
FIG. 2 is a top plan view of the apparatus shown in FIG. 1 and also showing, in phantom lines, the trailing tractor and the side casting blade in an alternate position.

Referring to FIGS. 1 and 2, apparatus in accordance with the invention generally comprises a leading tractor 1, a trailing tractor 12, and an adjustable side casting dozer blade assembly or blade 10 connected to and between the tractors. Blade 10, for example, is on the order of 60 feet long and 8½ feet high. The tractors 1 and 12 are substantially identical and each is of the conventional type and comprises a frame 22, a pair of tracks 24 and an engine 26 mounted on the frame for driving the tracks and for operating conventional hydraulic pumps (not shown) for powering conventional hydraulic actuators of cylinders on the tractor, as hereinafter described.

It is to be understood that both tractors 1 and 12 are to be operated or are under the control of a tractor operator located at the operator's station on the lead tractor 1, and means are provided whereby the operator can control all functions of lead tractor 1 by direct control and whereby he can remotely control all functions for trailing tractor 12 and for blade 10. Remote control of the trailing tractor engine throttle, drive line disengagement (the steering clutches), first gear forward and reverse transmission shift, and blade hydraulics (except those at the lead end of blade assembly 10) are understood to be carried out by means of air or hydraulic or electric control lines 21 from the operator's station on the lead tractor 1. The control of the lead end of blade assembly 10 is understood to be carried out directly by means of conventional hydraulic controls on the leading tractor 1 which are normally used for controlling a conventional ripper. It is to be understood that the remote control lines 21 are disconnectable so that each tractor 1 and 12 may be employed independently by separate operators in a conventional manner.

Lead tractor 1 is provided with optional dozer equipment generally disignated by the numeral 11 which, for example, includes a standard dozer blade and hydraulic actuators and control means therefor.

Means are provided for connecting the rear end of leading tractor 1 to the leading end of blade 10, and such means allow the blade to pivot universally in all directions, as well as include a means for effecting vertical adjustment (raising and lowering) of the leading end of the blade. The leading tractor 1 has a drawbar 2 attached to the rear end of its frame 22 and the drawbar is connected by means of a universal pivot connection 3 with one end of a rigid tongue or member 4 that extends rearwardly. The other end of tongue 4 is connected by means of a transverse (horizontal) pivot connection 5 to a vertically disposed rigid hitch member 6. Hitch member 6 is provided at its lower end with a ground-engaging breaker point 7 which facilitates blade engagement with the spoil bank at the proper depth. Hitch member 6 is pivotally connected by means of a vertical axis pivot pin connection 9 to the leading end of blade 10. An extendable and retractable hydraulic lift cylinder 8 is pivotally connected at one end by means of a transverse pivot connection 40 to the upper portion of hitch member 6. The other end of lift cylinder 8 is pivotally connected by a transverse pivot connection 42 to the forward end of tongue 4. Cylinder 8 is extendable and retractable to effect raising and lowering, respectively, of the leading end of blade 10.

Means are provided for connecting trailing tractor 12 to blade 10 at some distance from the trailing end of the blade and such means serve to stabilize the connection between the trailing tractor and the blade and also enable the blade angle, pitch, tilt, and vertical position to be adjusted. The trailing tractor 12 is provided with a C-frame 13 which is mounted by means of conventional trunions 14 to the tractor. C-frame 13 can be raised and lowered by means of a pair of conventional laterally spaced apart lift cylinders 15 which are mounted in a conventional manner on opposite sides of trailing tractor 12. Each lift cylinder 15 has its piston rod pivotally connected by means of a lateral pivot connection 27 to the front of C-frame 13. Extension or retraction of the cylinders 15 causes the blade 10 to be lowered or raised, respectively.

A universal connection 16 is provided for connecting a point near the right front corner of C-frame 13 to a point on the rear of blade 10 which is located a substantial distance inwardly from the trailing end of the blade and near the lower edge portion of the blade.

An extendable and retractable hydraulic blade angle cylinder 17 is connected at one end to the left hand forward part of the C-frame 13 by means of a universal connection 28 and has its other end connected by means of a universal connection 30 to a point near the middle rear of blade 10. The blade angle cylinder 17 and its universal connections 28 and 30 serve as a universally adjustable strut-type connection between C-frame 13 and blade 10. Operation of blade angle cylinder 17 enables the blade angle of blade 10 to be changed with relation to the trailing tractor 12. When cylinder 17 is fully retracted, as shown in solid lines in FIG. 2, a maximum attack angle of 50° for blade 10 is possible. A maximum width of cut is provided for. When blade angle cylinder 17 is fully extended, as shown in broken lines in FIG. 2, a minimum attack angle and minimum width of cut are provided for.

A pitch/tilt cylinder 18 is connected to the forward upper center of a tractor radiator guard 32 of trailing tractor 12 by means of a universal connection 34. Pitch/tilt cylinder 18 has its other end connected by means of a vertical pivot connection 36 to a point on the upper edge of blade 10 above universal connection 16. The pitch/tilt cylinder 18 provides both pitch control and tilt control of blade 10 and also provides for blade stability.

Extension or retraction of pitch/tilt cylinder 18 results in a pitch and tilt motion of blade 10 about an axis of rotation 20 that passes through the center of the universal connections 3 (on leading tractor 1) and 16 (on C-frame 13 of trailing tractor 12). Therefore, at any selected vertical position of blade 10, which is established by means of operation of tongue cylinder 8 (on leading tractor 1) and the lift cylinders 15 (on C-frame 13 of trailing tractor 12), when the pitch/tilt cylinder 18 is retracted the leading end of blade 10 will be lowered and the trailing end of the blade will be raised. This action is reversed if the pitch/tilt cylinder 18 is extended. This arrangement and capability make possible a simple and accurate means for coordinating the application of tractor drawbar pull applied to blade 10 under varying load conditions.

Pitch/tilt control gives the operator a simple and convenient means of coordinating the power output of the two tractors 1 and 12 when used in combination with the trailing tractor throttle control.

The apparatus shown in FIGS. 1 and 2 is operated in the following manner, for example, to reclaim strip mined land of the character shown in FIG. 3. FIG. 3 is a schematic top plan view of a portion of a geographic area which has been strip mined and shows the relative position of a plurality of generally parallel similar spoil banks 68, 50, 70 and 72 which are understood to be formed when strip mining operations are carried out on the land. As FIGS. 3 and 4 show, the spoil bank 50 is seen to comprise a first side or slope 52 on one side of the spoil bank crest line 54 and a second side or slope 56 on the other or opposite side of the crest line. The first slope 52 terminates at a line 58 defining the deepest portion of a first valley 60 on one side of spoil bank 50, and the second slope 56 terminates at a line 62 defining the deepest portion of a second valley 64 on the opposite side of the spoil bank 50.

FIG. 4 is an enlarged cross-sectional view of spoil bank 50 and its adjacent valleys 60 and 64 taken along line 4—4 in FIG. 3. In FIG. 4 the original grade line of the geographic area is designated 74 and a vertical center line or plane extending lengthwise through spoil bank 50 is designated 76. It may be assumed that the repose angles of the sides 52 and 56 of spoil bank 50 are each on the order of 35° from the horizontal, as indicated by angle $\alpha$ in FIG. 4.

FIG. 4 depicts the manner in which successive cuts or passes are made lengthwise of spoil bank 50 by the apparatus in accordance with the invention when employed in accordance with the method of the present invention. As FIG. 4 makes clear, alternate passes or cuts are made in opposite directions along the length of spoil bank 50, commencing downwardly from the top thereof so as to cut and laterally shift material from the spoil bank so that it descends under the force of gravity down a repose slope and into the appropriate adjacent valley 60 or 64. For example, a first pass is made along the length of spoil bank 50 substantially to one side of the center plane 76 to remove the material in the area designated A in FIG. 4, and this material slides down the repose slope 52 and comes to rest to occupy the cross-sectional area designated A′. After the first pass is completed, the apparatus is turned 180°, the side casting blade 10 is readjusted, and the apparatus is then moved in the opposite direction along the length of spoil bank 50 substantially to the other side of center plane 76 to remove material in the area designated B in FIG. 4, and this material slides down the repose slope 56 and comes to rest to occupy the area designated B′. Subsequently, successive passes or cuts are made in opposite directions on opposite sides of the center line 76 and in the areas designated C, D, E, F, G, H, I, J and K in FIG. 4. The material shifted from such areas comes to rest to occupy the corresponding cross-sectional areas designated C′ through K′, respectively, as shown in FIG. 4.

It will be noted that for each successive pass or cut blade 50 is readjusted by changing (increasing) the blade angle to increase the effective width of the blade slightly so that the width of each successive pass is greater than the preceding pass, and this is shown, for example, in the depiction in FIG. 4. Furthermore, blade 10 is readjusted by raising it slightly after each pass so that the depth of cut is reduced slightly for each successive cut or pass. This readjustment is necessary because, as FIG. 4 shows, blade 10 is required to move a mass of material of relatively greater width during each successive cut or pass. Furthermore, the tilt angle of blade 10 is changed (reduced) for each successive pass or cut, as FIG. 4 makes clear. It may be assumed, for example, that for making the initial pass or cut to remove material in area A in FIG. 4, the blade tilt angle is 15° from the horizontal and this angle is reduced by approximately 2° for each successive pass until blade 10 is horizontal when making the final pass or cut for area K.

It will be observed from FIG. 4 that, after the two passes for areas A and B are carried out, each succeeding pass for the areas C through J involves movement of material initially comprising the spoil bank 50, as well as a small additional amount of material on the repose slopes which was deposited thereat by each preceding pass or cut. However, the amount of material which is required to be moved more than once in accordance with the present invention amounts, for example, to approximately 12% of the total amount of material being moved, and this is a relatively conservative figure when compared to present methods of reducing or reclaiming spoil banks.

It is to be understood that in accordance with the present method the pass for area A is made in one direction and principally on one side of center line 76 of spoil bank 50, and the pass for area B is made in the opposite direction and substantially on the other side of center line 76. Two such passes comprise one cycle of operation. Five and one-half cycles are required in FIG. 4. It is to be further understood that the passes C, E, G, I and K are made in the same direction as pass A, and the passes D, F, H and J are made in the same direction and substantially on the same side of the center line as pass B.

The method in accordance with the invention enables fast, efficient continuous side casting of material in the spoil banks. The slope of the cut made on each pass and the cross-sectional shape of the area of the material removed on each pass tends to counter the side thrust of the angled side casting blade 10 and also reduces the amount of material required to be moved more than once by approximately 12%.

The apparatus in accordance with the present invention is so constructed that it can be turned 180° after each pass or cut in a very small turning radius. Furthermore, it will be apparent that it is advantageous for the single machine operator who is in full control of the apparatus to be located on leading tractor where he has a good forward view of the terrain on which he is operating.

I claim:

1. In apparatus for moving material laterally away from a path along which said apparatus travels comprising: a leading tractor; a trailing tractor located behind said leading tractor; a side casting blade located between said tractors and disposed at an angle with respect to said path, said blade having a leading end and a trailing end; first means for universally connecting said leading tractor near said leading end of said blade, said first means including selectively operable means for raising and lowering said leading end of said blade; and second means for connecting said trailing tractor to said blade at a location inward of the trailing end of said blade, said second means including selectively operable blade control means for raising and lowering said trailing end of said blade, for changing the angle of said blade and for changing the tilt of said blade.

2. Apparatus according to claim 1 wherein an operator's station is provided on said leading tractor and including control means at said operator's station for selectively operating said means for raising and lowering said leading end of said blade and further including remote control means at said operator's station and connected to said trailing tractor for selectively operating said blade control means.

3. Apparatus according to claim 1 wherein said first means comprises a vertically disposed hitch member, means for connecting said hitch member to said leading end of said blade for vertical pivotal movement with respect to said blade, a tongue, means for universally connecting one end of said tongue to said leading tractor, means for connecting the other end of said tongue to said hitch member for horizontal pivotal movement with respect to said hitch member, and an extendable and retractable hydraulic cylinder for raising and lowering said blade pivotally connected to a point near said one end of said tongue and to a point near the upper end of said hitch member.

4. Apparatus according to claim 3 wherein said second means comprises a C-frame pivotally connected to and extending around the front of said trailing tractor, an extendable and retractable hydraulic lift cylinder connected between said trailing tractor and said C-frame for raising and lowering the latter, means for universally connecting a first point near one corner of said C-frame to a first point on said blade located inwardly of the trailing end of the latter, an extendable and retractable hydraulic blade angle cylinder connected between a second point near the other corner of said C-frame and a second point on said located between said first on said blade and said leading end of said blade, and an extendable and retractable hydraulic pitch/tilt cylinder connected between a point on the front of said trailing tractor and a third point on said blade located inwardly of the trailing end of said blade and near the upper edge of said blade.

5. Apparatus according to claim 4 wherein an operator's station is provided on said leading tractor and including control means at said operator's station for selectively operating said means for raising and lowering said leading end of said blade and further including remote control means at said operator's station and connected to said trailing tractor for selectively operating said blade control means.

6. In apparatus for moving laterally away from a path along which said apparatus travels comprising: a leading tractor having an operator's control station thereon; a trailing tractor located behind said leading tractor; a side casting blade located between said tractors and disposed at an angle with respect to said path, said blade having a leading end and a trailing end; first means for universally connecting said leading end of said blade, said first means including a selectively operable lift cylinder for raising and lowering said leading end of said blade; second means for connecting said trailing tractor to said blade at a location inward of the trailing end of said blade, said second means including selectively operable blade control means including a lift cylinder for raising and lowering said trailing end of said blade, a blade angle cylinder for changing the angle of said blade and a tilt cylinder for changing the tilt of said blade; and control means at said operator's control station for operating both tractors and for selectively operating all of said cylinders.

7. Apparatus for moving material laterally away from a path along which said apparatus travels comprising: a leading tractor; a trailing tractor located behind said leading tractor; a side casting blade located between said tractors and disposed at an angle with respect to said path, said blade having a leading end and a trailing end; a first universal joint for connecting said leading tractor near said leading end of said blade, selectively operable means for raising and lowering said leading end of said blade; a second universal joint for connecting said trailing tractor to said blade at a location inward of the trailing end of said blade, and selectively operable blade control means for raising and lowering said trailing end of said blade, for changing the angle of said blade and for changing the tilt of said blade about an axis extending through said first and second universal joints.

8. Apparatus according to claim 7 including a frame pivotally connected to and extending from the front of said trailing tractor, an extendable and retractable hydraulic lift cylinder connected between said trailing tractor and said frame for raising and lowering the latter, said second universal joint connecting a first point on said frame to a first point on said blade located inwardly of the trailing end of the latter, an extendable and retractable hydraulic blade angle cylinder connected between a second point on said frame and a second point on said blade located between said first point on said blade and said leading end of said blade, and an extendable and retractable hydraulic pitch/tilt cylinder connected between a point on said trailing tractor and a third point on said blade located inwardly of the trailing end of said blade and near the upper edge of said blade.

9. Apparatus according to claim 8 including a vertically disposed hitch member, means for connecting said hitch member to said leading end of said blade for vertical pivotal movement with respect to said blade, a tongue, said first universal joint universally connecting one end of said tongue to said leading tractor, means for connecting the other end of said tongue to said hitch member for horizontal pivotal movement with respect to said hitch member, and an extendable and retractable hydraulic cylinder for raising and lowering said blade pivotally connected to a point near said one end of said tongue and to a point near the upper end of said hitch member.

10. Apparatus according to claim 9 wherein an operator's station is provided on said leading tractor and including control means at said operator's station for selectively operating said means for raising and lowering said leading end of said blade and further including remote control means at said operator's station and connected to said trailing tractor for selectively operating said blade control means.

11. Apparatus for moving material laterally away from a path along which said apparatus travels comprising: a leading tractor having an operator's control station thereon; a trailing tractor located behind said leading tractor; a side casting blade located between said tractors and disposed at an angle with respect to said path, said blade having a leading end and a trailing end; a first universal joint for universally connecting said leading tractor near said leading end of said blade, a selectively operable lift cylinder for raising and lowering said leading end of said blade; a second universal joint for connecting said trailing tractor to said blade at a location inward of the trailing end of said blade, selectively operable blade control means including a lift cylinder for raising and lowering said trailing end of said blade, a blade angle cylinder for changing the angle of said blade and a tilt cylinder for changing the tilt of said blade about the axis extending through said first and second universal joints; and control means at said operator's control station for operating both tractors and for selectively operating all of said cylinders.

12. Apparatus according to claim 11 including a C-frame pivotally connected to an extending around the front of said trailing tractor, said hydraulic lift cylinder being extendable and retractable and connected between said trailing tractor and said C-frame for raising and lowering the latter, said second universal joint connecting a first point near one corner of said C-frame to a first point on said blade located inwardly of the trailing end of the latter, said hydraulic blade angle cylinder being extendable and retractable and connected between a second point near the other corner of said C-frame and a second point on said blade located between said first point on said blade and said leading end of said blade, and said hydraulic pitch/tilt cylinder being extendable and retractable and connected between a point on the front of said trailing tractor and a third point on said blade located inwardly of the trailing end of said blade and near the upper edge of said blade.

13. Apparatus according to claim 12 including a vertically disposed hitch member, means for connecting said hitch member to said leading end of said blade for vertical pivotal movement with respect to said blade, a tongue, said first universal joint universally connecting one end of said tongue to said leading tractor, means for connecting the other end of said tongue to said hitch member for horizontal pivotal movement with respect to said hitch member, and an extendable and retractable hydraulic cylinder for raising and lowering said blade pivotally connected to a point near one end of said tongue and to a point near the upper end of said hitch member.

14. Apparatus according to claim 12 wherein an operator's station is provided on said leading tractor and including control means at said operator's station for selectively operating said means for raising and lowering said leading end of said blade and further including remote control means at said operator's station and connected to said trailing tractor for selectively operating said blade control means.

* * * * *